United States Patent [19]

Bowers

[11] 4,131,262

[45] Dec. 26, 1978

[54] DEVICE FOR RETAINING HOT TOP LINING SLABS

[75] Inventor: John W. Bowers, Guelph, Canada

[73] Assignee: Foseco International Limited, Birmingham, United Kingdom

[21] Appl. No.: 799,057

[22] Filed: May 20, 1977

[30] Foreign Application Priority Data

May 27, 1976 [GB] United Kingdom ..... 22122/76
Jul. 23, 1976 [CA] Canada ..... 257705

[51] Int. Cl.[2] ..... B22D 7/10
[52] U.S. Cl. ..... 249/202; 249/198
[58] Field of Search ..... 249/106, 197–202

[56] References Cited

U.S. PATENT DOCUMENTS

| | | | |
|---|---|---|---|
| 1,182,374 | 5/1916 | Howard et al. | 249/106 |
| 3,713,621 | 1/1973 | Davidson | 249/197 |
| 3,746,298 | 7/1973 | Witt | 249/197 |
| 3,893,645 | 7/1975 | Marcec | 249/202 |

FOREIGN PATENT DOCUMENTS

| | | | |
|---|---|---|---|
| 1538502 | 9/1968 | France | 249/198 |

*Primary Examiner*—Francis S. Husar
*Assistant Examiner*—John McQuade
*Attorney, Agent, or Firm*—Caesar, Rivise, Bernstein & Cohen, Ltd.

[57] ABSTRACT

This invention relates to an end cap to be fitted to an end edge of a hot top lining slab to receive a wedge member whereby in use the slab can be urged against the wall of an ingot mould, the end cap comprising a first portion to abut an end edge of the slab, and a second portion arranged to lie, when the first portion abuts the slab edge, against one major face of the slab, the second portion including a shoulder against which a wedge can be engaged, the shoulder being located spaced from the first portion and one end of the shoulder being more remote from the first portion than the other end of the shoulder.

8 Claims, 18 Drawing Figures

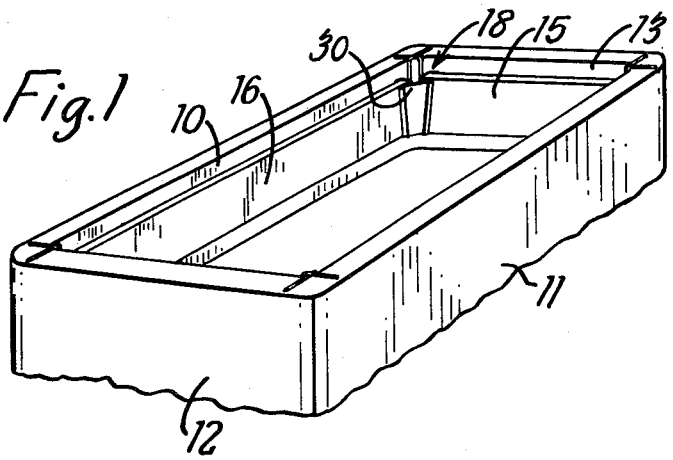
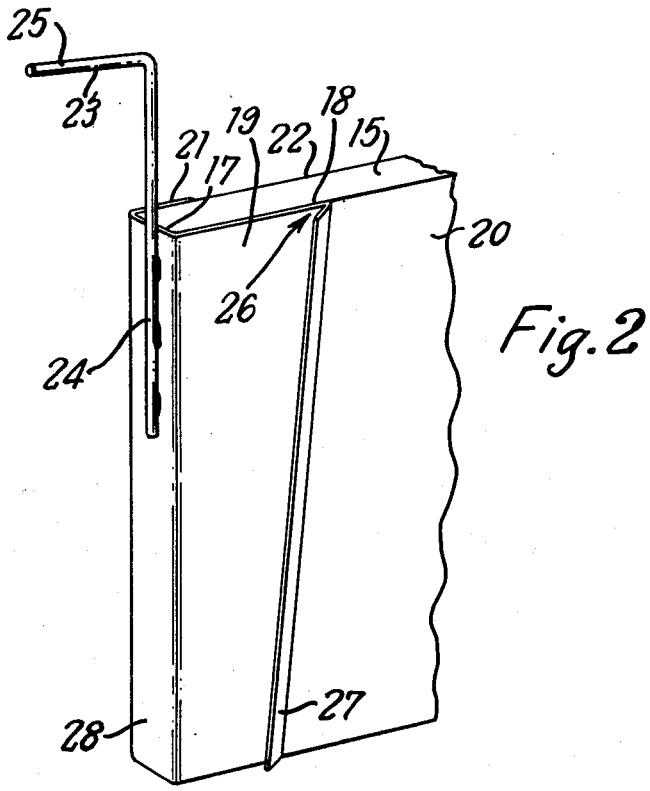
Fig.2

DEVICE FOR RETAINING HOT TOP LINING SLABS

This invention relates to hot top lining slabs and their fixture in the heads of metal casting moulds, particularly ingot casting moulds.

Such slabs, which may be of a heat-insulating or exothermic nature, are placed in the head of a casting mould in order to reduce loss of heat from the molten metal just after teeming, so enabling the head metal to keep molten and to feed to the body of the ingot or like casting during solidification. This avoids the formation of "pipe", i.e. of shrinkage cavities, in the cast metal. Such slabs are conventionally of rectangular substantially parallelopiped shape and are usually in the form of a tile of thickness much smaller than its length or breadth. For simplicity of expression herein, the large area faces of such a tile are called the major faces, the other four faces being called respectively end edges (the two faces usually lying in substantially vertical planes in the assembled hot top lining) and sides (the two faces usually lying in substantially horizontal planes in the assembled hot top lining).

Many methods of assembling hot top linings and holding them in place during casting have been suggested. For example, it is known to use four lining slabs and four wedges made of substantially the same material as the lining slabs. Hammering such wedges in the corners is a skilled operation if the wedges are not be broken, either requiring a new wedge or at least leading to wedge material coming to lie in the casting mould from which it must be removed prior to pouring molten metal.

It has also been proposed to provide grooves cut in the lining slabs to receive the wedge sides. This is an improvement, in that it dispenses with breakable wedges, but has the disadvantage that the grooves cut in the slabs weaken the slabs, which accordingly have to be reinforced with chickenwire. Even such reinforcement does not avoid fracture of the slabs in practice, which may lead to the slab needing to be replaced, or at least to the mould needing to be cleaned before casting commences.

According to a first feature of the present invention there is provided an end cap to be fitted to an end edge of a hot top lining slab to receive a wedge member whereby in use the slab can be urged against the wall of an ingot mould, the end cap comprising a first portion to abut an end edge of the slab, and a second portion arranged to lie, when the first portion abuts the slab edge, against one major face of the slab, the second portion including a shoulder against which a wedge member can be engaged, the shoulder being located spaced from the first portion and one end of the shoulder being more remote from the first portion than the other end of the shoulder.

Such an end cap may include a third portion adapted to engage one side of the lining slab and/or a fourth portion adapted, when the cap is fitted to the end edge of a hot top lining slab, to lie adjacent the other major face of the slab.

The cap may include one or more projections arranged, when the cap is fitted on the slab, to anchor in the slab and thereby to secure the cap against falling from the slab. Such anchoring projections may be tangs struck from one or more of the portions of the cap. Also, the cap may include a cranked member with a first part extending from the cap and a second part extending substantially perpendicular to the first part and adapted to support the cap by engagement on a horizontal ledge, e.g. the top of a mould or head box in which the hot top assembly is to be located. Such a cranked member may be constructed so that the distance between the second part of the member and the first portion of the cap is adjustable to enable the height of the assembly in the mould or head box to be varied.

In one preferred form the end cap of the invention is generally "U" shaped in plan, the arms of the "U" being adapted to engage opposite major faces of a hot top slab, one of the arms being generally trapezoidal in elevation with the sides of the trapezoid perpendicular to the base of the "U" parallel to each other, the free edge of the trapezoid remote from the base returning upon itself outwardly of the "U" to provide a shoulder.

According to a further feature of the invention there is provided a hot top lining assembly comprising, in an ingot mould head or head box a plurality of hot top lining slabs lining the walls of the mould or head box, an end cap fitted on each end of each lining slab, and a wedge member engaging the adjacent end caps and biasing them apart to hold the slabs firmly in position, the end caps each having a shoulder adjacent the inwards facing major face of the slab, inclined downwardly towards the end edge of the slab, and against which one side of the wedge member is engaged.

It is found that using the end caps according to the invention it is possible to assemble hot top linings quickly and efficiently without risk of breakage of the lining slabs and accordingly without risk of contamination of the interior of the casting mould. The use of an end cap on a preformed slab indeed tends to reinforce the strength of the slab and naturally aids in distributing the wedging force evenly over the slab rather than allowing it to concentrate at one or more points causing fracture of the slab. Thus, there is no need to reinforce the slab during manufacture with chicken wire or like metal mesh. Such reinforcement is necessary for a slab having a groove to receive a wedge member, especially in the vicinity of the groove to compensate for weakness introduced into the slab by the groove.

The wedge member is conveniently a wedge-shaped flat metal plate, e.g. of the same type of metal as is being cast.

The end caps may be made of any convenient material, usually metal such as mild steel or spring steel, and are conveniently formed in one piece of metal.

End caps according to the present invention are "handed" i.e. they are left-hand or right-hand end caps depending upon whether they are to be placed on the left or right-hand end edge of a lining slab in a hot top lining assembly. Naturally, a left-hand end cap is the inverse of a right-hand end cap.

In the manufacture of the end caps of the invention they may be formed in pairs of left and right-hand caps and subsequently divided. Accordingly, the invention includes in combination a left-hand and a right-hand end cap according to the invention formed together from one piece of metal.

The invention is illustrated in further detail and by way of various examples in the accompanying drawings in which:

FIG. 1 is a perspective view from above of the top of an ingot mould including a hot top lining assembly according to the present invention;

FIG. 2 is a perspective view of one end of a hot top lining slab and an end cap used in the assembly of FIG. 1;

Figure 3:
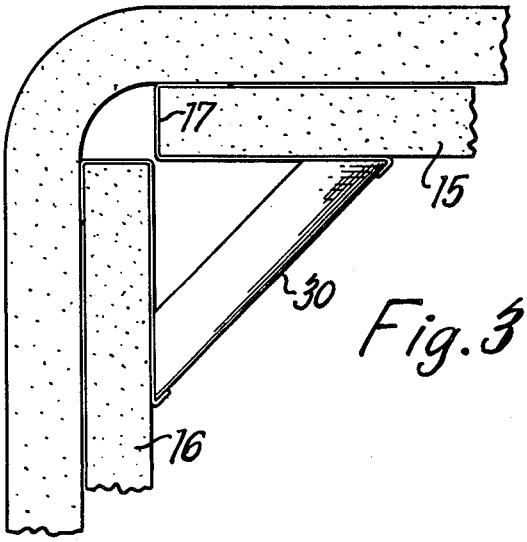
FIG. 3 is a plan view of one corner of the assembly shown in FIG. 1.
Figure 4:
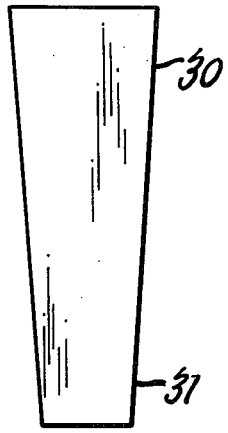
FIG. 4 is a plan view of a metal wedge, four of which are used in the assembly of FIG. 1.

Referring first to FIGS. 1 to 4 of the accompanying drawings, these show a typical embodiment of a hot top lining assembly according to the invention. Four hot top linings slabs of which only two numbered 15 and 16 can be seen in FIG. 1, line the four walls, 10, 11, 12 and 13 of an ingot mould. At each of the corners of the mould there is a end cap assembly consisting of a metal wedge plate 30 and two end caps 18. The construction of each end cap is seen in more detail in FIG. 2.

As can be seen from FIG. 2, each end cap 18 has a first portion 28 which abuts the end edge 17 of slab 15. Each end cap 18 also has a second portion 19 which lies in contact with the major face 20 of slab 15 and which is terminated by a bent back flange 27 forming a channel indicated at 26. As can be seen in FIG. 2, one end of flange 27 and accordingly channel 26 is more remote from the first portion 28 then the other end thereof.

The end cap 18 has a further portion 21 connected to portion 28 and which is adapted to lie against the other major face 22 of slab 15. In this way, the whole of the end cap 18 may be held on the end of slab 15 by spring action provided that the metal of which end cap 18 is made is sufficiently resilient.

Welded to portion 28 of cap 18 is a rod 24 having an upper bent away portion 23 terminating in a free end 25. This free end 25 is rested on the upper surface of one of the walls of the ingot mould 10, 11, 12, 13 and this serves to set the height of slab 15 in the ingot mould and to hold the slab in that position during assembly until the wedges 30 can be inserted in the respective grooves 26 and hammered tight.

It can easily be seen that the end caps serve a variety of purposes in the assembly and fixture of the hot top lining slabs. They act both as supporting jigs to position the slabs in the mould, as protectors for the end edges of the slabs during such handling and as reinforcements enabling the slabs to be urged against the mould walls by metal wedges without fracture of the slabs.

Figure 5:
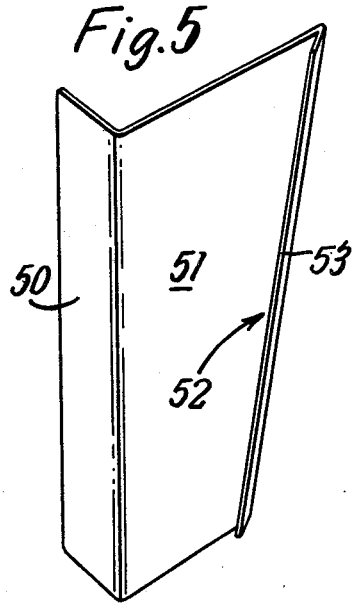
FIGS. 5 to 9 are each views of alternative end caps is perspective.

FIG. 5 shows another end cap which has a first portion 50 adapted to engage the end edge of the slab and a second portion 51 which is adapted to lie against the face of the slab and which terminates in a channel 52 formed by a bent back angled flange 53. During assembly of the top top assembly using such an end cap, it may be necessary to hold the cap in position on the end of the slab temporarily, e.g. with a spot of adhesive.

Figure 6:
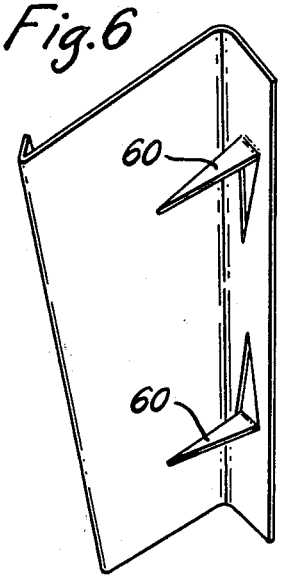

The end cap shown in FIG. 6 has anchoring tangs 60 struck from the body of the first portion which tangs are driven into the slab from the end edge to anchor the cap to the slab.

Figure 7:
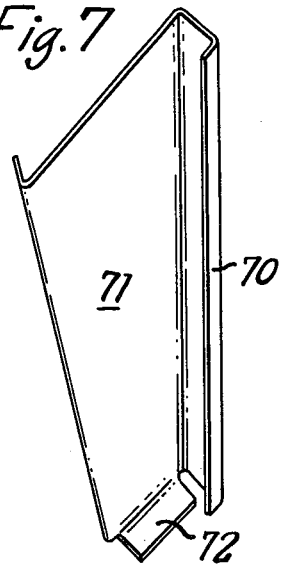

In the end cap shown in FIG. 7, securement on the end edge of a hot top lining slab may be achieved by means of the engagement of portions 70 and 71 on opposite sides of the slab and additionally the cap shown in FIG. 7 has a flange 72 to prevent any slippage of the slab in the vertical direction during assembly.

Figure 8:
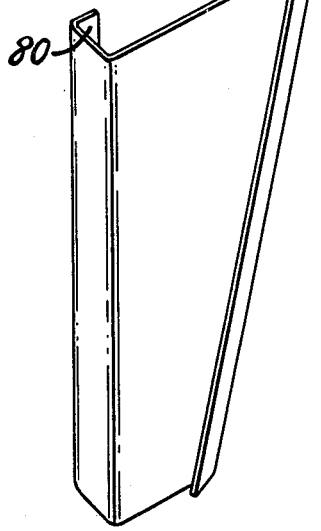

The end cap shown in FIG. 8 is similar to that shown in FIG. 5 but has the addition of a flange 80 of function analogous to that of flange 70 in the cap shown in FIG. 7.

Figure 9:
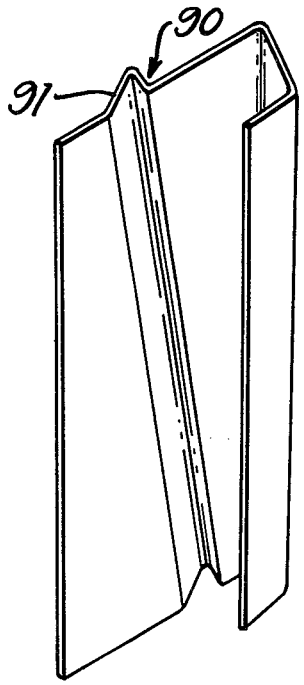

It is not always necessary to form the inclined groove by folding back the edge of the metal used to make the end cap. As shown in the embodiment of FIG. 9. the groove there designated 90 may be formed by pressing an appropriate rib 91 into the metal from which the end cap is made so leaving an extra flat portion to abut the major face of the slab remote from the first portion and to enhance engagement of cap and slab.

Figure 10:
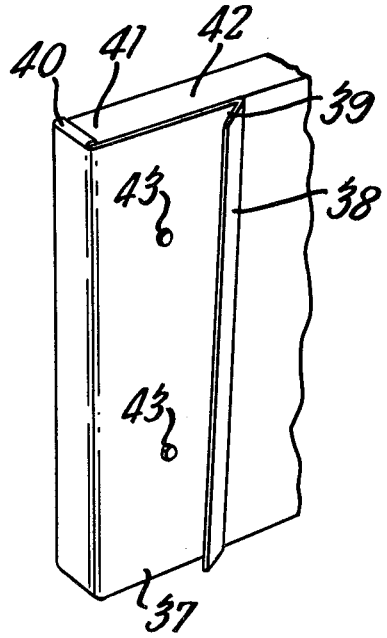
FIG. 10 is a view of a further alternative shown engaged on the end of a hot top lining slab.
Figure 11:
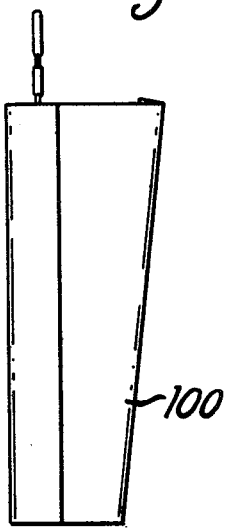
FIGS. 11 to 14 are front, back, side and top views respectively of an end cap having an adjustable cranked member.
Figure 12:
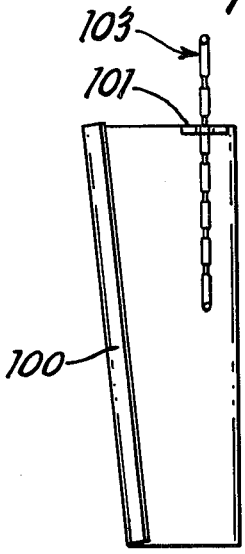
Figure 13:
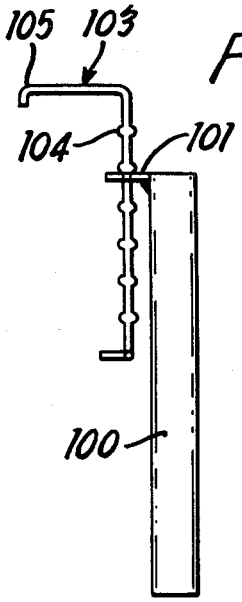
Figure 14:
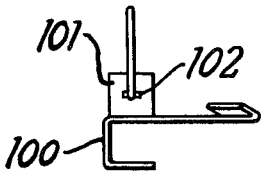

The end cap of FIG. 10 is shown attached to a hot top lining slab 42. In order to locate the cap accurately on the slab it has a flange 40 which engages the top side 41 of slab 42 and in order to hold the cap on the slab 42 two apertures are provided in portion 37. Through these, nails 43 are hammered. A flange 38 is folded back to form a groove 39 in similar fashion to that described above.

The end cap shown in FIGS. 11 to 14 consists of two parts which may be separated from one another. The basic cap construction is unchanged but the bent metal plate 100 forming the cap has at its upper edge a laterally extending plate 101 having a central elongate slot 102. A bar 103 is fitted in slot 102. Bar 103 has a plurality of flattened portions 104 which when aligned with slot 102 can pass through it but on which plate 101 can rest when bar 103 is turned so that portions 104 run at right angles to slot 102 when seen from above. The end 105 of bar 103 can in such position rest on the top of the ingot mould in order to hang a slab in a pair of such end caps in the mould at the desired height. The actual height will depend upon which of the portions 104 is located underneath plate 101.

Figure 15:
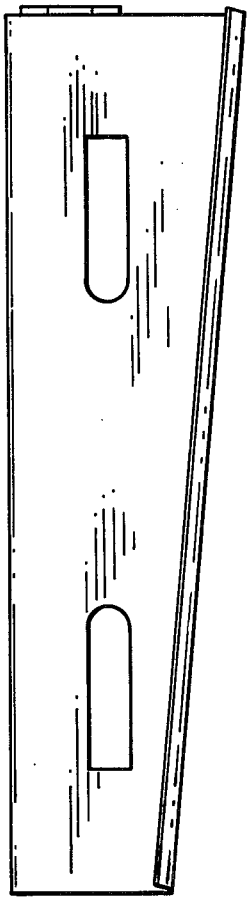
FIGS. 15, 16 and 17 are side, end and top views respectively of an alternative embodiment to that of FIGS. 11 to 14 but with the extending piece not shown.
Figure 16:
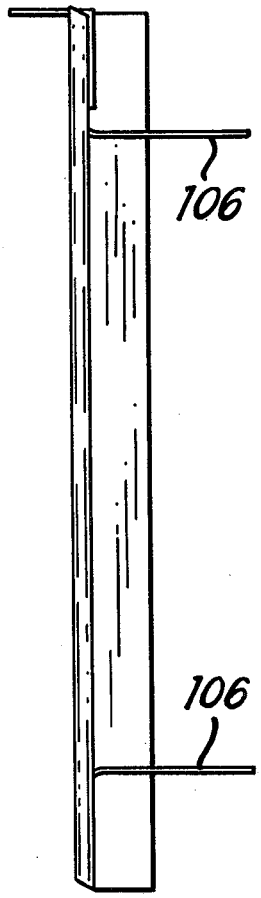
Figure 17:
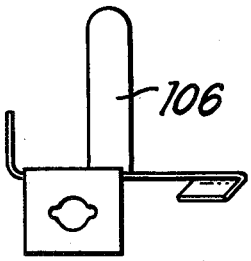

FIGS. 15 and 17 show a modification of the end cap just described with regard to FIGS. 11 to 14 in which the end cap may be affixed to the slab by means of a pair of tabs 106 which are stamped out from the metal of the end cap and which may be pressed into the material of the hot top lining slab, having their ends if they emerge from the rear face of the slab bent back flat against the slab.

Figure 18:
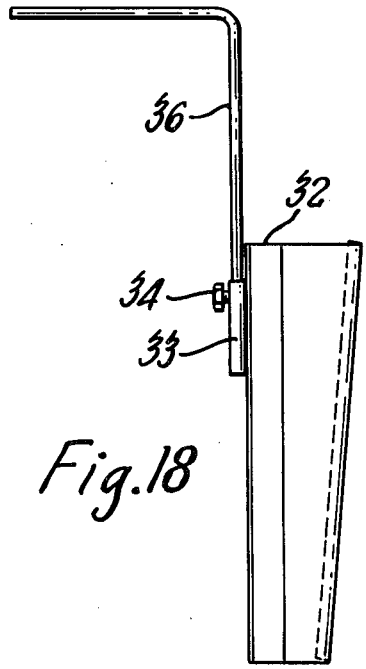
FIG. 18 is a side view of yet a further embodiment of an end cap according to the present invention showing an alternative adjustable cranked member.

FIG. 18 shows yet a further embodiment in which the end cap 32 bears a sleeve 33 welded to the portion which lies in use against the end edge of the hot top lining slab. Sleeve 33 receives a cranked bar 36 which can be held in any position by means of a locking nut 34 screw threadedly mounted in the wall of tube 33.

Various of the end caps shown in the drawings have been assembled as shown in FIG. 1 in ingot moulds and molten steel cast at 1650° C. into those moulds in the usual way. The molten steel was teemed until it reached the top of the lining and thereafter the ingot was allowed to cool and solidify. It was observed during all of these tests that there was no instance of any of the lining slabs floating on the surface of the molten metal and the assembly of the lining slabs remained intact throughout the casting sequence. Removal of the ingot mould from the cast ingot and subsequent removal of the hot top lining residues could be accomplished without difficulty. The end caps and wedges had become incorporated into the solidified head metal of the ingot.

I claim:

1. An end cap assembly for use with a hot top slab for a casting mold, said slab having an inwardly facing surface, an outwardly facing surface and an edge portion, said end cap assembly comprising an end cap having a plate portion whose height is substantially equal to the depth of said slab and which bears against the inwardly facing surface of said slab, and a wedging plate having an edge portion, said plate portion having one portion bent to define a passageway to receive the edge portion of the wedging plate, said wedging plate having a height substantially equal to the depth of said slab, the passageway in said plate portion being downwardly and outwardly inclined, with respect to the edge portion of said slab, means to secure the plate portion to said slab and suspension means connected to said end cap for supporting said end cap and said slab on said casting mold.

2. The end cap assembly of claim 1 in which the plate portion is trapezoidal in shape, with the longest side of said plate portion forming the wedging receiving passageway.

3. The end cap assembly of claim 1 wherein said end cap is a generally U-shaped member having one arm forming said plate portion, a second arm shaped to frictionally engage the outwardly facing surface of the hot top slab and a bight abutting the edge portion of the hot top slab.

4. The end cap assembly of claim 1 wherein said end cap is a generally L-shaped member having a pair of arms one arm forming said plate portion, and the other arm abutting the edge portion of the hot top slab.

5. The end cap assembly of claim 1 wherein said suspension means is adjustable for adjusting the vertical position of said end cap.

6. The end cap assembly of claim 1 including projection means anchoring said slab to said end cap.

7. The end cap assembly of claim 6 wherein said projection means comprise tangs struck from a portion of said end cap.

8. The end cap assembly of claim 7 wherein said end cap is formed in one piece of metal.

* * * * *